United States Patent [19]

Dräger et al.

[11] Patent Number: 4,711,402

[45] Date of Patent: Dec. 8, 1987

[54] APPARATUS FOR REDUCING THE SIZE OF AND/OR FOR MIXING SOLID, PASTY AND/OR LIQUID MATERIAL

[75] Inventors: Uwe Dräger; Norbert Dräger, both of Krefeld, Fed. Rep. of Germany

[73] Assignee: DET-Dräger-Energie-Technik GmbH & Co. KG, Wachtendonk, Fed. Rep. of Germany

[21] Appl. No.: 891,788

[22] Filed: Jul. 30, 1986

[51] Int. Cl.[4] ..... B02C 15/08

[52] U.S. Cl. ..... 241/101.2; 241/126; 366/288

[58] Field of Search ..... 241/114, 101.2, 123–133, 241/203; 366/261, 287, 288, 297

[56] References Cited

U.S. PATENT DOCUMENTS

| | | | |
|---|---|---|---|
| 1,349,235 | 8/1920 | Stout | 241/132 X |
| 4,063,687 | 12/1977 | Szego | 241/132 X |

FOREIGN PATENT DOCUMENTS

| | | | |
|---|---|---|---|
| 325029 | 9/1920 | Fed. Rep. of Germany . | |
| 2152218 | 2/1973 | Fed. Rep. of Germany . | |
| 2542109 | 3/1977 | Fed. Rep. of Germany . | |
| 1112939 | 3/1956 | France | 241/131 |
| 158018 | 1/1933 | Switzerland . | |

*Primary Examiner*—Mark Rosenbaum

*Attorney, Agent, or Firm*—Becker & Becker, Inc.

[57] ABSTRACT

An apparatus for reducing the size of, and/or for mixing, solid, pasty and/or liquid material. The apparatus includes a cylindrical housing in which is disposed at least one grinding roller, which cooperates with the inner surface of the housing. Each grinding roller is mounted between two bearing disks in such a way as to be rotatable about its central axis and eccentrically relative to the central axis of the housing. The bearing disks in turn are rotatably driven about the central axis of the housing. In order to enable the grinding rollers to execute the necessary deflection movements, and to avoid over stressing the bearings or supports for the grinding rollers, both end faces of each grinding roller are provided with an axle end that is guided, with play, between two drive wheels that are rotatably mounted on the bearing disks. When the bearing disks rotate, the drive wheels rotatably drive the grinding rollers, which are pressed by centrifugal force against the inner surface of the housing. The housing is provided with at least one guide ring to guide the grinding rollers in the axial direction. Each guide ring has at least one guide surface that extends at an angle to the central axis of the housing, and each grinding roller is provided with correspondingly inclined contact surfaces that cooperate with these guide surfaces.

11 Claims, 3 Drawing Figures

APPARATUS FOR REDUCING THE SIZE OF AND/OR FOR MIXING SOLID, PASTY AND/OR LIQUID MATERIAL

BACKGROUND OF THE INVENTION

The present invention relates to an apparatus for reducing the size of, and/or for mixing, solid, pasty and/or liquid material. The apparatus includes a cylindrical housing that is preferably disposed in a vertical position. Disposed in the housing is at least one grinding roller, which cooperates with the inner surface of the housing. Each grinding roller is mounted between two bearing disks in such a way as to be rotatable about its central axis and eccentrically relative to the central axis of the housing. The bearing disks in turn are rotatably driven about the central axis of the housing.

Apparatus of this general type, which are also known as roll or planetary mills or grinders, are known in various forms. The peripheral surfaces of their grinding rollers press the material that is to be reduced in size or mixed against the inner surface of the housing. These grinding rollers must be in the position to move inwardly when pieces of material that are too hard or too large pass through in order to avoid undue stress or even destruction.

With one heretofore known embodiment, as disclosed in Swiss Patent No. 158 018, to provide for this inward movement the grinding rollers are resiliently embodied, for example in the manner of a helical spring. A helical spring also forms the grinding roller body in German Offenlegungsschrift No. 2,542 109, which furthermore provides the possibility for adjustment in the radial direction by having its central axis formed from a flexible wire cable.

The drawback of these heretofore known apparatus is that the mobility of the grinding rollers that operate along the inner surface of the housing cannot be limited to a movement that is radial relative to the central axis of the housing. On the contrary, such movements include displacement of the central axes of the grinding rollers in the circumferential direction, i.e. in the direction of movement of the grinding rollers. This leads to pivoting movements of the grinding rollers in the direction of their circular path, which in turn leads to great wear of the inner surface of the housing and of the surface of the grinding rollers.

Furthermore, these pivoting movements result in unforeseeably great axial forces in the mounting of the grinding rollers. As a result of the high speeds involved, these axial forces cannot be overcome very well, and in a short period of time destroy the mountings for the grinding rollers.

Proceeding from an apparatus of the aforementioned general type, it is an object of the present invention, while avoiding the aforementioned drawbacks, to provide an arrangement and mounting of the grinding rollers that, while providing a straightforward construction and great functional reliability, makes it possible for the grinding rollers to deflect radially, yet avoids the generation of unduly great axial mounting or bearing forces.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
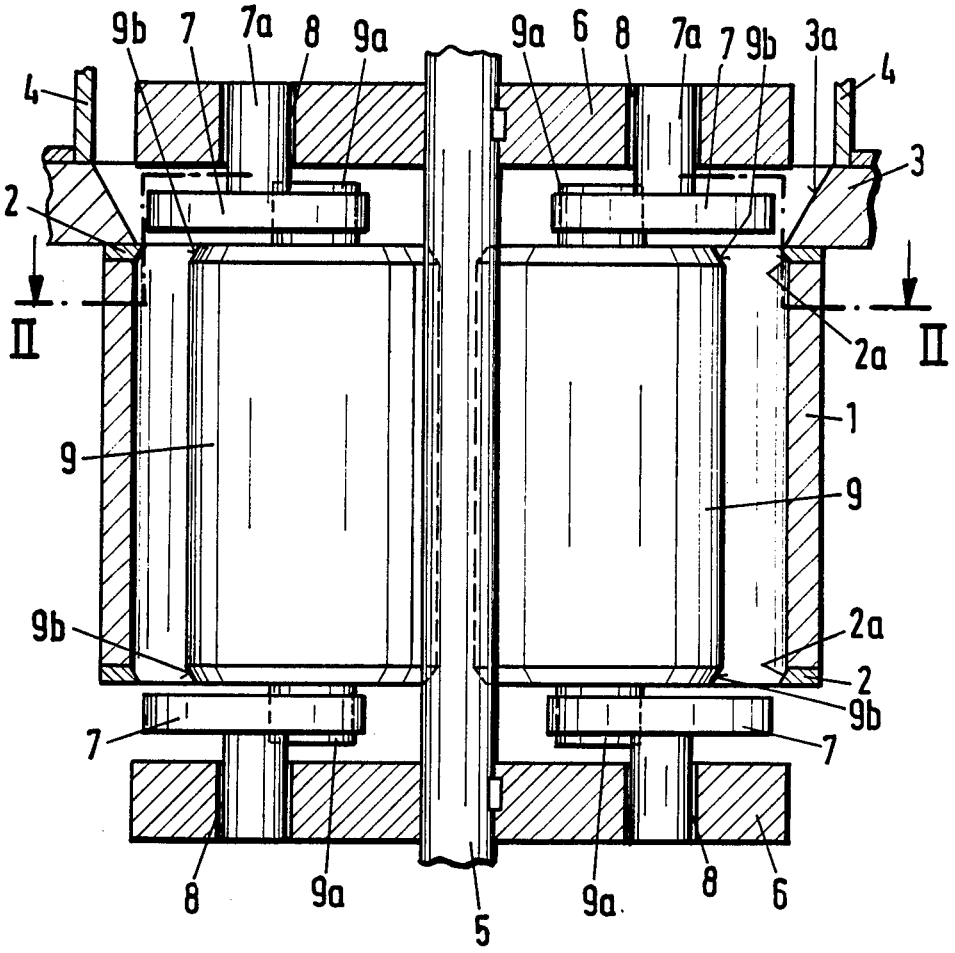
FIG. 1 is a cross-sectional view through one exemplary embodiment of the inventive apparatus.

The inventive apparatus for reducing the size of, and/or for mixing, solid, pasty and/or liquid material comprises: a cylindrical housing having an inner surface and a central axis; at least one grinding roller, each of which cooperates with the inner surface of the housing, with each grinding roller also having a central axis, and with each grinding roller being rotatable about its central axis and eccentrically relative to the central axis of the housing; each grinding roller furthermore has two opposed end faces, each of which is provided with an axle end disposed in the central axis of that grinding roller; two bearing disks that are rotatably driven about the central axis of the housing, with the grinding rollers being disposed between the bearing disks; drive wheels respectively rotatably mounted on one of the bearing disks, with each axle end of the grinding rollers being guided, with play, between two drive wheels, so that when the bearing disks rotate, the drive wheels rotatably drive the grinding rollers, which are pressed by centrifugal force against the inner surface of the housing; and at least one guide ring provided on the housing for guiding the grinding rollers in the axial direction, with each guide ring having at least one guide surface that extends at an angle to the central axis of the housing, and with each grinding roller being provided with correspondingly inclined contact surface means that cooperate with the guide rings to effect the axial guidance of the grinding rollers.

With the present invention, the drive wheels, which act upon the axle ends, guide the grinding rollers along their path. The arrangement of the drive wheels is such that the contact points of the grinding rollers at the top and bottom are guided with a limited amount of play, so that the grinding rollers can move radially to a limited extent in the direction toward the central axis of the housing when this is required by the nature of the material that is being ground. However, a pivoting movement of the grinding rollers in the direction of movement of the latter along their circular path is limited by the drive wheels that are disposed ahead of and behind the axle ends. Since with such a pivoting movement the axle ends of the grinding rollers move away from at least one of the drive wheels, the wear generated by such pivot movements is reduced considerably. As a result of the inventive support of the grinding rollers on at least one guide ring, forces that occur in the axial direction are not transmitted via the axle ends, but rather are introduced into the housing via the guide ring. The support and drive of the grinding rollers are thus protected from any significant wear. The guide rings are provided in an easily removable manner.

The inventive design results not only in a greater functional reliability and a longer service life, but also makes it possible to rapidly disassemble the apparatus without any difficulty, for example in order to clean the apparatus. Finally, the inventive design provides for a significant reduction of the bearing or support speeds in the bearing disks, so that economical components can be utilized.

Pursuant to a further feature of the present invention, the cylindrical peripheral surfaces of the axle ends and of the drive wheels are smooth, so that the driving-along function is effected by friction. Pursuant to an alternative embodiment, these cylindrical peripheral surfaces of the axle ends and of the drive wheels could also be provided with teeth in order to effect the driving-along function via a positive connection.

Pursuant to one preferred embodiment of the present invention, each of the ends of the housing is provided with a guide ring that has an inclined guide surface, with both ends of each grinding roller being chamfered in conformity to the inclination of the guide surfaces to form contact surfaces. Such a design makes it quite simple to replace the guide rings.

Pursuant to a further feature of the present invention, it is possible to dispose on the inner surface of the housing at least one guide ring that has a truncated-cone cross-sectional area, and to provide the grinding rollers with a bearing groove that corresponds to this area of the guide ring, so that the forces that act in the axial direction of the housing are absorbed by this guide ring, which can be provided either in place of the guide rings disposed at both ends of the housing, or in addition to these guide rings. It is to be understood that it is also possible to provide a plurality of such guide rings on the inner surface of the housing. In order to simplify mounting of these guide rings that are disposed on the inner surface of the housing, the latter can be divided into a number of parts between which the guide rings are secured.

This makes it possible to provide the inventive apparatus with any desired axial length. A further advantage is that due to the fact that the guide rings project inwardly, the product or material that is to be ground or mixed is forced to leave the inner surface of the housing, as a result of which in conjunction with the previously resulting build up or accumulation, the grinding and mixing effect is intensified. This effect can be repeated as often as desired, whereby, for example in the upper portion of the apparatus, greater spacing can be provided between the guide rings in order to grind large-grained material. In the last stage of the apparatus, finely profiled guide rings can be provided in order to achieve a high degree of final fineness. Thus, it is a simple matter to affect the quality of the grinding.

Pursuant to another preferred embodiment of the present invention, a plurality of grinding rollers and drive wheels are distributed over the periphery, with each drive wheel cooperating with the axle ends of the adjacent grinding rollers.

The bearing disks are preferably mounted together with the drive wheels on a common main shaft. Inventively, this main shaft can be provided with deflection plates that are disposed either at right angles or at an angle to the axis of rotation of the main shaft, and can extend into annular recesses of the grinding rollers. As a consequence of the speed of the main shaft, these deflection plates again hurl or throw the material that was thrown from the grinding rollers toward the middle back into the grinding region between the grinding rollers and the housing. This assures that no unground material falls through into the interior of the apparatus. By setting the deflection plates at an angle, a paddle effect can be achieved that results in an intensive mixing for mixing processes.

Further features of the present invention will be described in detail subsequently.

DESCRIPTION OF PREFERRED EMBODIMENTS

Referring now to the drawings in detail, the illustrated apparatus is intended, for example, for reducing the size of coal or for reducing the size of, and mixing, chemical products. The apparatus includes a cylindrical housing 1 which in both illustrated embodiments is disposed in a vertical position. A respective guide ring 2 is removably secured at either end of the housing 1; each of the guide rings 2 has a guide surface **2*a* that extends at an angle to the centerline of the housing. Adjoining the upper guide ring 2 is a housing ring 3 that is provided with a funnel-like inclined inlet surface 3*a*, and on which in turn are arranged feed plates 4** to form an annular feed means for material that is to be ground and mixed.

In a suitable manner, not illustrated in the drawings, a central main shaft 5 is rotatably mounted on the housing 1. Secured beyond the cylindrical housing 1, on this main shaft 5, are bearing disks 6 on which in turn are mounted drive wheels 7. The sleeves 8 that are used for mounting the axle ends **7*a* of these drive wheels 7 are indicated in FIG. 1**.

Figure 2:
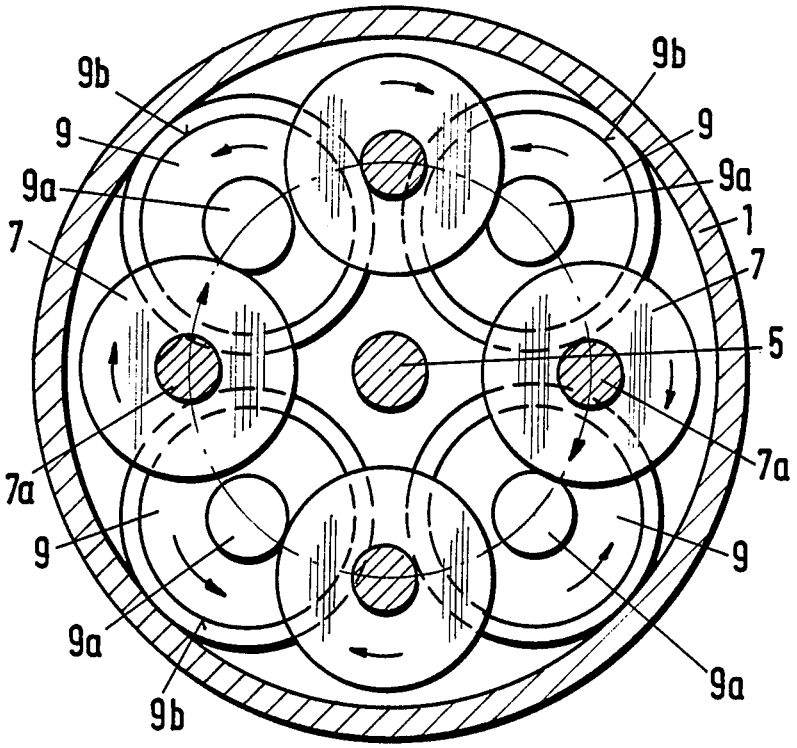
FIG. 2 is a cross-sectional view taken along the line II—II in FIG. 1.

In the illustrated embodiment of FIGS. 1 and 2, four drive wheels 7 are respectively uniformly distributed over the periphery of each bearing disk 6. The axle ends **9*a* of grinding rollers 9 are guided with the aid of the drive wheels 7. The grinding rollers 9 have a cylindrical surface, and rest against the inner surface of the housing 1, as can be seen in FIG. 2. This figure also shows that in the normal case the central axes of the grinding rollers 9 are disposed on the same circle as the axes of rotation of the drive wheels 7. The diameter of the drive wheels 7 and the diameter of the axle ends 9*a* are such that the axle ends 9*a* of the grinding rollers 9 do not become restrained between adjacent drive wheels 7. Rather, a certain amount of play remains, with this play making it possible for the grinding rollers 9 to move inwardly in a radial direction if larger and harder pieces of the material that is to be ground get between the inner surface of the housing 1 and the grinding rollers 9. As can be seen from the plan view of FIG. 2, this radial mobility of the axle ends 9a, and hence of the grinding rollers 9 is limited, so that only limited pivot movements of the grinding rollers 9 in the direction of rotation are possible. The direction of rotation of not only the bearing disks 6 but also of the drive wheels 7 and the grinding rollers 9 are indicated by arrows in FIG. 2**.

In the embodiment of FIGS. 1 and 2, to absorb axial forces the ends of the grinding rollers 9 are chamfered to form contact surfaces **9*b* with which the grinding rollers 9 rest in the axial direction of the housing 1 on the guide surfaces 2*a* of the guide rings 2. In this way, forces in the axial direction are not conveyed via the axle ends 9*a* and the drive wheels 7, but rather are introduced directly into the housing 1 via the guide rings or transfer rings 2**.

Figure 3:
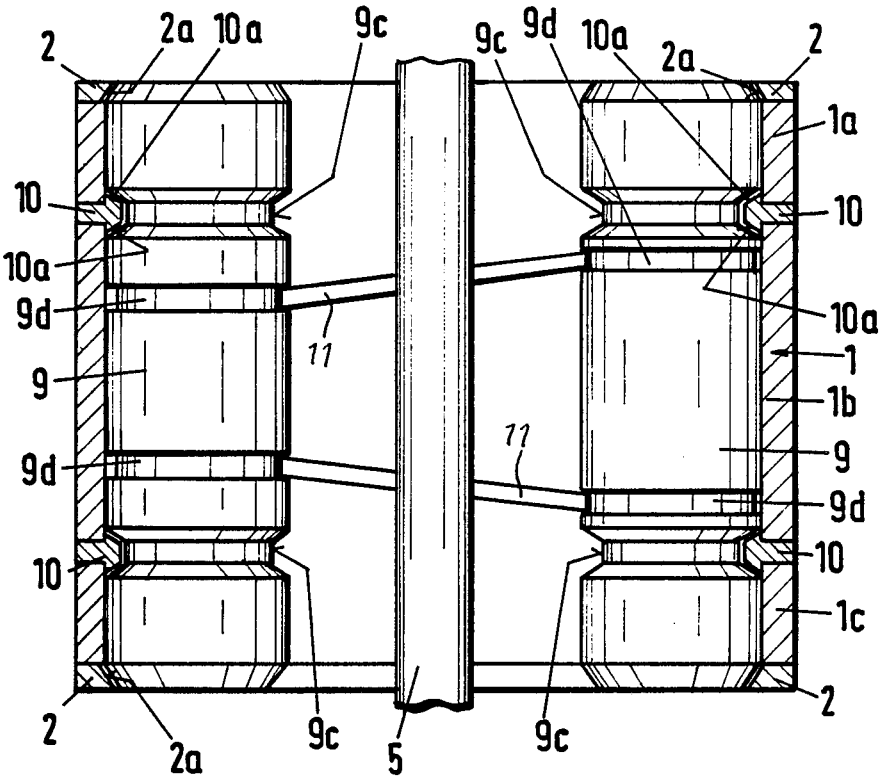
FIG. 3 is a cross-sectional view through a second exemplary embodiment of the inventive apparatus.

In the second embodiment of FIG. 3, which in other respects corresponds to the embodiment of FIGS. 1 and 2, the cylindrical housing 1 is divided into three parts **1*a*, 1*b*, and 1*c*. Guide rings 2 having guide surfaces 2*a* on one side are again disposed at the end of the housing 1. Furthermore, additional guide rings 10 are disposed between the central housing part 1*b* and the outer housing parts 1*a* and 1*c* respectively. These guide rings or transfer rings 10 have a truncated-cone cross-sectional area that projects inwardly from the inner surface of the housing 1. This truncated-cone cross-sectional area forms two guide surfaces 10***a* that cooperate with each grinding roller 9. This cooperation between the guide surfaces 10*a* and the grinding rollers 9 is effected in that appropriate locations of the grinding rollers 9 are provided with appropriate bearing grooves 9*c* that have corresponding bearing surfaces that in turn cooperate with the aforementioned guide surfaces 10*a* of the guide rings 10. This provides additional support for the grinding rollers 9 relative to the housing 1 in the axial direction.

In the embodiment of FIG. 3, deflection plates 11 are disposed on the main shaft 5. These deflection plates 11 rotate with the main shaft 5 and extend into annular recesses 9*d* of the grinding rollers 9. The deflection plates 11 prevent material that is to be ground or mixed from passing into the center of the housing 1 without having been handled by the grinding rollers 9. The deflection plates 11 guide this material back on to the peripheral surfaces of the grinding rollers 9, which subsequently guide the material to the inner wall of the housing 1 where the material is processed.

The present invention is, of course, in no way restricted to the specific disclosure of the specification and drawings, but also encompasses any modifications within the scope of the appended claims.

What we claim is:

1. An apparatus for reducing the size of, and/or for mixing, solid, pasty and/or liquid material, said apparatus comprising:

a cylindrical housing having an inner surface and a central axis;

at least one grinding roller, each of which cooperates with said inner surface of said housing; each grinding roller also has a central axis, with each grinding roller being rotatable about its central axis and eccentrically relative to said central axis of said housing; each grinding roller has two opposed end faces, each of which is provided with an axle end that is disposed on said central axis of that grinding roller;

two bearing disks, that are rotatably driven about said central axis of said housing, with each grinding roller being disposed between said bearing disks;

drive wheels respectively rotatably mounted on one of said bearing disks, with each of said axle ends being guided, with play, between two drive wheels in such a way that when said bearing disks rotate, said drive wheels rotatably drive said grinding rollers, which are pressed by centrifugal force against said inner surface of said housing; and at least one guide ring provided on said housing for guiding each grinding roller in a direction parallel to its central axis; each of said guide rings has at least one guide surface that extends at an angle to said central axis of said housing, and each guide roller is provided with correspondingly inclined contact surface means that cooperate with said guide surfaces to effect said axial guidance of said guide rollers.

2. An apparatus according to claim 1, in which said drive wheels and said axle ends of said grinding rollers are provided with smooth cylindrical peripheral surfaces.

3. An apparatus according to claim 1, in which said drive wheels and said axle ends of said grinding rollers are provided with toothed cylindrical peripheral surfaces.

4. An apparatus according to claim 1, in which said housing has two axial ends, at each of which is provided one of said guide rings, each of which has an inclined guide surface; and in which each end of a given grinding roller is chamfered, in conformity with the angle of inclination of said guide surfaces, to form said inclined contact surface means.

5. An apparatus according to claim 1, in which said inner surface of said housing is provided with at least one guide ring having an inwardly extending portion with a truncated-cone cross-sectional shape to form guide surfaces; and in which each of said grinding rollers is provided with groove means that correspond to said cross-sectional shape of said inwardly extending portion of said guide rings.

6. An apparatus according to claim 1, which includes a plurality of grinding rollers and drive wheels uniformly distributed about said inner surface of said housing and about the periphery of said bearing disks, with each of said drive wheels cooperating with said axle ends of grinding rollers adjacent to that drive wheel.

7. An apparatus according to claim 1, which includes a main shaft disposed along said central axis of said housing, with said bearing disks, together with said drive wheels mounted thereon, being mounted on said main shaft.

8. An apparatus according to claim 7, in which said main shaft is provided with deflection plates.

9. An apparatus according to claim 8, in which said grinding rollers are provided with annular recesses into which said deflection plates extend.

10. An apparatus according to claim 8, in which said deflection plates are disposed at right angles to the axis of rotation of said main shaft.

11. An apparatus according to claim 8, in which said deflection plates are disposed at an angle to the axis of rotation of said main shaft.

* * * * *